United States Patent [19]

Boan et al.

[11] Patent Number: 4,700,195

[45] Date of Patent: Oct. 13, 1987

[54] WAVEGUIDE FED COMPOSITE HORN ANTENNA

[75] Inventors: Bobby J. Boan, Indian Harbour Beach; William F. Croswell, Melbourne, both of Fla.

[73] Assignee: Harris Corporation, Melbourne, Fla.

[21] Appl. No.: 782,550

[22] Filed: Oct. 1, 1985

[51] Int. Cl.[4] ..... H01Q 13/00

[52] U.S. Cl. ..... 343/786; 343/872; 343/878; 343/DIG. 2

[58] Field of Search ..... 343/772, 781 R, 786, 343/DIG. 2, 872, 878, 771, 873

[56] References Cited

U.S. PATENT DOCUMENTS

| | | | |
|---|---|---|---|
| 3,860,933 | 1/1975 | Terakawa et al. | 343/786 |
| 4,246,584 | 1/1981 | Noerpel | 343/786 |
| 4,477,816 | 10/1984 | Cho | 343/786 |
| 4,517,571 | 5/1985 | Mulliner et al. | 343/872 |

*Primary Examiner*—William L. Sikes
*Assistant Examiner*—Robert E. Wise
*Attorney, Agent, or Firm*—Antonelli, Terry & Wands

[57] ABSTRACT

A waveguide-fed horn structure includes a constraining mechanism having an extremely high degree of dimensional stability over a wide thermal range. The constraining mechanism comprises a composite graphite honeycomb structure that forms a support backing for the waveguide feed and for the conductive surface sections of the horn radiator. The conductive surface of the horn radiator is supported on a first section of graphite epoxy laminate while a second section of graphite epoxy laminate supports the honeycomb backing and is bonded to the first section of laminate, thereby effectively surrounding the feed-horn structure with a thermally tolerant, physical distortion constraining support. The graphite epoxy support provides sufficient mass and mechanical stiffness to prevent performance degrading distortion of both the waveguide feed and the horn radiator surface in spite of the severe transient thermal conditions encountered in a spaceborne environment, thereby maintaining structural integrity of the components of the structure during extreme thermal cycling conditions (full sun to no sun).

24 Claims, 3 Drawing Figures

WAVEGUIDE FED COMPOSITE HORN ANTENNA

FIELD OF THE INVENTION

The present invention relates to microwave antenna structure and is particularly directed to a waveguide fed horn antenna for use in severe thermal stress environments (e.g. a space-deployed structure).

BACKGROUND OF THE INVENTION

The successful operation of satellite communication systems requires the use of components that are capable of withstanding severe, and often rapid, changes in environmental conditions (e.g. rapid thermal transients in response to changes in solar exposure (full sun-vs-eclipse)). Because of these demands, structural elements that are acceptable for terrestrial use are often unsuited for spaceborne applications, without a substantial modification of hardware design. This problem is particularly accute with respect to the electrical components of antenna structures which employ metallic surfaces for signal coupling functions (e.g. aluminum waveguide feeds) and for the radiating components (e.g. aluminum/copper-surfaced horn elements). Because of the substantial magnitudes of their coefficients of thermal expansion, the metallic structures suffer from inherent dimensional instability; the resulting physical distortion (e.g. warping, bowing of the horn and feed structures) changes the field pattern characteristics of the antenna, thereby adversely affecting its performance. Moreover, repeated thermal cycling of the structures may lead to structural fatigue and eventual separation of components of the antenna structure.

One approach for dealing with this problem has been to provide error tolerance performance through the use of a large number of radiator and intercoupled feed elements for which a complex support framework is required. This approach is, in effect, a brute force solution, adding to the antenna considerable size and weight, precious commodities from an earth to space transport standpoint.

SUMMARY OF THE INVENTION

In accordance with the present invention there is provided a horn antenna configuration that offers considerably improved dimensional stability over conventional waveguide-fed horn structures, yet is lightweight, high gain and of reduced size, thereby satisfying both performance and payload objectives of space-deployed antennas. To this end, the present invention couples to a waveguide-fed horn structure a constraining mechanism that enjoys an extremely high degree of dimensional stability over a wide thermal range. Preferably the constraining mechanism comprises a composite graphite and honeycomb structure that forms a support backing for the waveguide feed and for the conductive surface sections of the horn radiator. The conductive surface of the horn radiator is supported on a first section of graphite epoxy laminate while a second section of graphite epoxy laminate supports the honeycomb backing and is bonded to the first section of laminate, thereby effectively surrounding the feed-horn structure with a thermally tolerant, physical distortion constraining support. The graphite epoxy support provides sufficient mass and mechanical stiffness to prevent performance degrading distortion of both the waveguide feed and the horn radiator surface in spite of the severe transient thermal conditions encountered in a spaceborne environment, thereby maintaining structural integrity of the components of the structure during extreme thermal cycling conditions (full sun to eclipse). An epoxy adhesive is employed to secure the waveguide feed to the graphite epoxy laminate and a syntactic filter is injected between the regions of the enveloping composite laminate wherein the honeycomb backing is provided. Because the resulting structure has high gain, lighter weight and has considerably improved thermal stability than conventional horn structures, it is especially suited to a wide variety of spacecraft applications.

DETAILED DESCRIPTION

Figure 1:
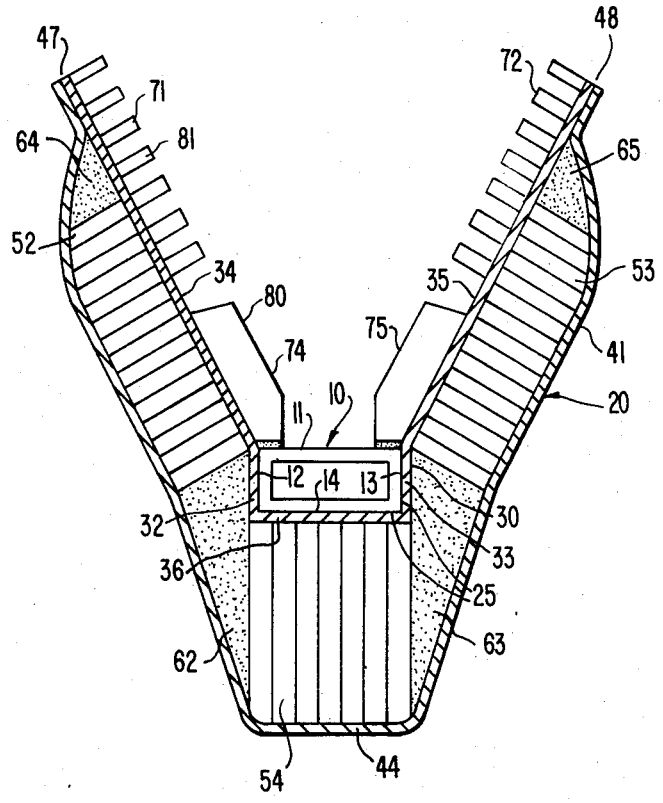
FIG. 1 is a cross-sectional side view of a waveguide-fed composite horn antenna having corrugated horn surface configuration.

Referring now to FIG. 1, a cross-sectional side view of a waveguide-fed composite horn antenna in accordance with the present invention is shown as comprising a metallic (e.g. aluminum) waveguide feed element 10 and a surrounding constraining composite horn structure 20. In the exemplary embodiment of the invention illustrated in FIG. 1, the antenna is a vertically polarized antenna having a corrugated horn surface. The waveguide 10, which forms the radiator feed component for the horn, has a top surface 11 facing the direction of electromagnetic radiation emission, side surfaces 12 and 13, and a bottom surface 14. Slot openings (not shown) are periodically distributed (in a direction normal to the plane of the drawing) in the top surface 11 of the waveguide 10 for launching the vertically polarized wave.

The horn component of the antenna is comprised of a flared section of graphite epoxy laminate having a first flared portion 34 and a second flared portion 35 which extend from the outer extremities 47, 48 of the horn to a third, pocket portion 30. Pocket portion 30 is comprised of side walls 32 and 33 and bottom wall 36, contiguous with one another and being sized to receive and provide a snug fit for the side walls 12 and 13 and the bottom wall 14 of the aluminum waveguide feed element 10. A thin layer 25 of bonding epoxy is provided between the outer wall surface portions 12, 13, 14 of the waveguide 10 and the inner wall surface portions 32, 33, 36 of the pocket portion 30 to secure waveguide feed 10 in pocket portion 30.

Electrically contiguous with the top surface 11 of the waveguide feed element 10 is a thin conductor layer (e.g. copper) 80, which extends over a pair of enlarged launch defining portions 74 and 75 and a plurality of corrugations 71 and 72, spaced apart from the enlarged portions 74 and 75 and extending to the outer extremities of the flared portions 34 and 35 of the graphite epoxy laminate horn. The corrugations 71 and 72 and enlarged portions 74 and 75 of the copper surface are filled with a syntactic filler material or graphite roving to provide sufficient support and lightweight mass for the corrugations and the enlarged portions in their completed structural form. The copper surface 80 of the interior of the horn is electrically and physically connected to the top surface 11 of the waveguide 10 by respective layers of conductive adhesive 21 and 22.

In order to constrain the waveguide feed 10 and the conductive surface 80 of the flared portion of the horn, honeycomb backing sections 52 and 53 of graphite composite material (e.g. Nomex honeycomb) are provided as backing layers along flared sections 34 and 35 of the epoxy laminate walls of the horn, and a bottom section 54 of honeycomb graphite composite material is provided along the bottom wall portion 36 of the pocket 30 of the graphite epoxy laminate horn structure. The depth of the bottom section 54 of graphite composite material is greater than the thickness of each of the side sections 52 and 53 adjacent to the flared sections 34 and 35 of the epoxy horn laminate and is sufficiently large so as to effectively shift the center of mass of the pocket portion 30 (including the waveguide 10) to a location beneath the bottom wall 36 of the pocket portion 30. This shifting of the center of mass of the aluminum waveguide feed elements to a location in backing section 54, that undergoes no substantial mechanical distortion for changes in thermal input, effectively assists in constraining the waveguide from distortion in response to thermal changes.

An outer skin member 41, comprised of the same graphite epoxy laminate structure as the flared wall portions of the horn itself, extends from the outer extremities 47, 48 of the horn and surrounds the backing sections 52, 53 and 54 of graphite composite honeycomb. Those portions of the volume of space with the horn structure defined by outer skin member 41 and flared wall members 34 and 35 and not occupied by backing sections 44, 52, 53 are filled with a syntactic filler at regions 62 and 63 adjacent the sides of the bottom layer of honeycomb composite 54 and the outer extremity portions of the flared walls of the horn at regions 64 and 65.

Because the coefficient of thermal expansion of the graphite epoxy material of walls 34 and 35, pocket portion 30 and outer skin member 41, as well as that of the honeycomb backing material 52, 53 and 54, is extremely low (less than $1\times10^{-6}$in./in./degree F.), the aluminum waveguide feed element 10 is substantially surrounded with a constraining member that undergoes almost no distortion for the significant temperature swings encountered in a spaceborne environment for which the present invention is intended. Moreover, as mentioned above, because of the substantial thickness of the honeycomb graphite backing section 54 adjacent to the bottom wall of the pocket 30 in which the aluminum waveguide feed element 10 is constrained, the effective center of mass of the waveguide feed 10 is displaced outside the waveguide to a location which undergoes almost no displacement for substantial changes in temperature. As a result, deformation of the waveguide feed is effectively minimized.

Figure 2:
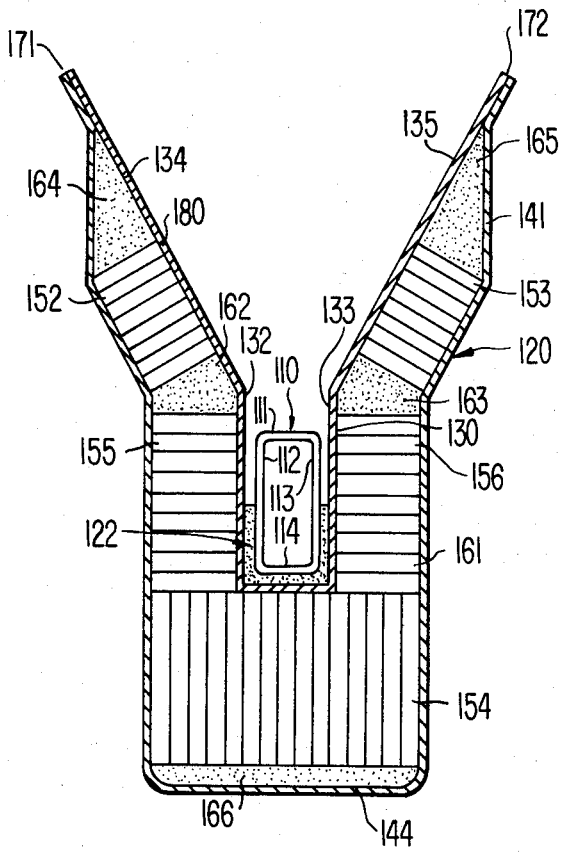
FIG. 2 is a cross-sectional side view of a waveguide-fed composite horn antenna having a flat horn surface configuration.

FIG. 2 shows an embodiment of the present invention wherein the waveguide is disposed to provide horizontally polarized radiation and the surface of the horn is essentially flat or smooth, (i.e. without the corrugations employed in the embodiment shown in FIG. 1). In this configuration, the aluminum waveguide feed 110 is also essentially of rectangular cross-sectional configuration with one of the narrow edges forming the top surface 111 and acting as a radiation launching surface. Side walls 113 and 112 of feed 110 extend from the top surface 111 to a bottom wall 114 of the waveguide. Portions of the side walls 112 and 113 of waveguide 110 are electrically and physically joined via a suitable conductive adhesive to a metallic (e.g. copper) layer 180 which is formed on a pair of flared wall portions 134 and 135 of an epoxy graphite laminate horn structure 120, a pocket portion 130 of which receives the waveguide 110. A layer of epoxy adhesive 122 is provided on side walls 112, 113 and on bottom wall 114 to secure waveguide 110 in pocket portion 130.

Side walls 132, 133 of the pocket portion 130 and the flared wall portions 134, 135 of the epoxy laminate are backed with respective sections 155, 156 and 152, 153 honeycomb structured graphite material (e.g. Nomex honeycomb) to provide a thermal response constraint mechanism for the interior metallic surfaces of the foreign structure. Similarly, a bottom section 154 of graphite honeycomb material is disposed adjacent bottom wall 114 of the waveguide 110 and side sections 155 and 156. This honeycomb graphite backing structure is surrounded by an outer skin member 141, formed of a layer of graphite epoxy laminate which extends from the outer extremities 171 and 172 of the flared horn portion to a bottom wall portion 144 and envelops the sections of backing material 152–156. Regions of syntactic filler 161–165 are disposed in the vacant space of the interior of the horn structure adjacent to the sections of honeycomb graphite composite so as to provide a completely solid interior of the composite horn structure.

As is the case with the embodiment of the composite structure shown in FIG. 1, described above, through the use of the epoxy laminate layers and the honeycomb graphite backing sections, the waveguide-fed horn structure is surrounded with a distortion constraining mechanism having an extremely low coefficient of thermal expansion, with the constraining mechanism effectively shifting the center of mass of the waveguide launching feed to a location in the graphite honeycomb material, thereby preventing distortion of both the waveguide feed and the flared sections of the horn itself.

Figure 3:
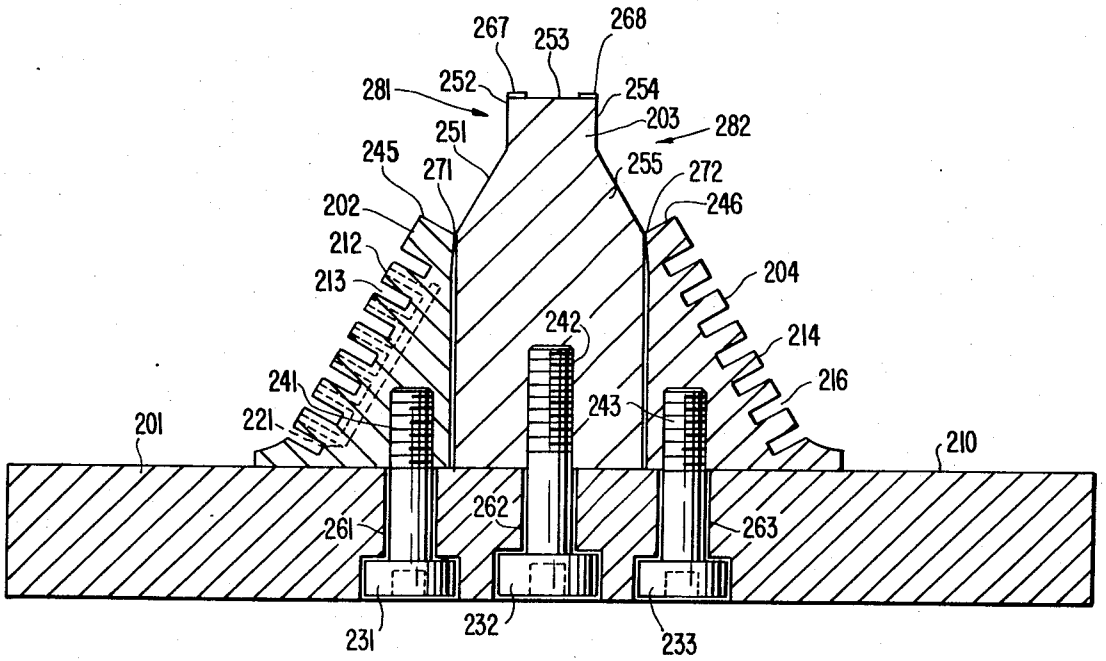
FIG. 3 is a cross-sectional side view of a mandrel for forming the corrugated antenna horn configuration of FIG. 1.

Manufacture of the composite horn structure preferably employs a mandrel, shaped to conform with the flared horn section. An illustration of a suitable mandrel for forming the corrugated horn structure of FIG. 1 is shown in FIG. 3. As shown therein, on the top surface 210 of a base plate 201 respective mandrel sections 202, 203 and 204 are secured by way of threaded dowel pins 231, 232 and 233, which extend through respective slots 261, 262 and 263 in base plate 201 and engage threaded (tapped) slots 241, 242 and 243 in sections 202, 203 and 204, respectively.

Each of outer sections 202 and 204 is shaped to provide respective corrugations 212, 214 spaced by gaps 213 and 216 therebetween, as shown. The central section 203 of the mandrel has a top surface 253 from which extend vertical side walls 252 and 254 and inclined walls 251 and 255. Inclined walls 251 and 255 intersect and walls 245 and 246 of the respective sections 202 and 203 at vertices 271 and 272, as shown, thereby providing outer surface outline regions 281, 282 of enlarged launching regions 74 and 75 of the horn configuration shown in FIG. 1.

After the mandrel sections have been secured to the base plate in the configuration shown in FIG. 3, a thin layer of copper (preferably on the order of 1-to-2 mils thickness) is deposited (either electro deposited or electroless deposited) on the mandrel. Next, in regions 281 and 282 and within the gaps 213 and 216 of the corrugation portions, an epoxy-impregnated graphite carbon cord is formed and allowed to cure, thereby providing a syntactic filler for sections 74 and 75 and corrugations 71 and 72 of the configuration shown in FIG. 1.

Thereafter, a portion of the copper which has been deposited on top surface 253 of the central mandrel section 203 is removed and a conductive adhesive is applied at regions 267 and 268 to secure a section of waveguide feed having openings therein facing the top surface 253 of the central mandrel section 203. Next, a structural adhesive is applied to the outer walls 12 and 13 and bottom wall 14 of the waveguide and a laminated structure comprising successive layers of resin-impregnated bidirectional graphite is formed over the waveguide and mandrel structure. Preferably, the graphite is caused to conform to the surface under vacuum. It is then allowed to cure at room temperature, so as to complete the formation of the pocket portion 30 and the flared wall portion 34 and 35 of the horn configuration shown in FIG. 1.

Next, Nomex honeycomb graphite backing sections 52, 53 and 54 are adhesively bonded to the backs of flared epoxy laminate sections 34 and 35 and the bottom wall portion 34 of the pocket 30. After the bonding adhesive for the honeycomb epoxy graphite section has been allowed to cure at room temperature, clamps which have secured the honeycomb backing to the graphite laminate structure are removed and the honeycomb backing is trimmed to the desired final shape. Open areas of the structure between the honeycomb backing layers and at the extremities of the horn are filled with a syntactic filler, thereby providing sections 62, 63, 64 and 65, as shown in FIG. 1. After the structure has been allowed to cure at room temperature, successive layers of resin-impregnated bidrectional graphite are formed over the resulting structure to build up the skin 41. This graphite skin structure is caused to conform to the outer surface of the honeycomb and syntactic filter regions under vacuum; it is then cured at room temperature.

Through the use of air stripping ports, one 221 of which is shown in mandrel section 202 of FIG. 3, the horn configuration is then lifted off the mandrel. The resulting structure, when inverted, corresponds identically to what is shown in FIG. 1.

In the manufacture of the configuration shown in FIG. 2, substantially the same procedure described above for the horn structure shown in FIG. 1 is carried out, except that the outer surface of the mandrel employed is shaped to conform with the intended smooth surface of the configuration of FIG. 2 (i.e. there being no corrugations).

As will be appreciated from the foregoing description, the present invention provides an improved waveguide-fed horn antenna structure that is especially suitable for a spaceborne environment. By the provision of an effectively thermally insensitive mechanical distortion constraining mechanism, bowing or warping of both the metallic waveguide feed element and the horn radiator itself are avoided. Thus, a considerable improvement in performance is obtained. Moreover, because of its light weight and reduced physical size, the constraining mechanism yields an overall horn antenna configuration that is "practical" in terms of both launch payload and deployment, as contrasted with the bulky and complex structures heretofore employed.

While we have shown and described several embodiments in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

What is claimed:

1. A waveguide-fed horn antenna comprising:

a section of waveguide one surface of which has apertures therein for coupling electromagnetic radiation between the interior of the waveguide and a region external to said waveguide;

a horn member having a recessed pocket portion for receiving said section of waveguide and a pair of flared portions extending from said pocket portion and opening to said region external to said waveguide, interior faces of said flared portions containing conductive material that is electrically contiguous with said waveguide;

a region of deformation constraining dielectric material disposed adjacent to said recessed pocket portion of said horn member; and a thermally insulative outer wall member extending from said flared portions of said horn member and confining said region of deformation constraining dielectric material.

2. A waveguide-fed horn antenna according to claim 1, wherein said region of deformation constraining dielectric material comprises a first region of cellular dielectric material disposed adjacent to a bottom wall of said pocket portion and extending away therefrom toward outer wall member.

3. A waveguide-fed horn antenna according to claim 2, wherein said region of deformation constraining dielectric material comprises second and third regions of cellular dielectric material secured to said pair of flared wall portions thereof and extending away therefrom toward said outer wall member.

4. A waveguide-fed horn antenna according to claim 3, further including a dielectric filler material disposed in interior space regions defined between said outer wall member and said horn member adjacent to regions of deformation constraining cellular dielectric material.

5. A waveguide-fed horn antenna according to claim 4, wherein said cellular dielectric material has a honeycomb structure.

6. A waveguide-fed horn antenna according to claim 4, wherein each of said horn member and said outer wall member comprises graphite-containing laminate material.

7. A waveguide-fed horn antenna according to claim 6, wherein said interior faces of said flared portions of said horn member are formed of a layer of conductive material disposed on the graphite-containing laminate material thereof.

8. A waveguide-fed horn antenna according to claim 2, wherein said region of deformation constraining dielectric material comprises second and third regions of cellular dielectric material secured to side wall portions of said pocket portion and extending away therefrom toward said outer wall member.

9. A waveguide-fed horn antenna according to claim 8, wherein said region of deformation constraining dielectric material comprises fourth and fifth regions of cellular dielectric material secured to said pair of flared wall portions thereof and extending away therefrom toward said outer wall member.

10. A waveguide-fed horn antenna according to claim 9, further including a dielectric filler material disposed in interior space regions defined between said outer wall member and said horn member adjacent to regions of deformation constraining cellular dielectric material.

11. A waveguide-fed horn antenna according to claim 10, wherein each of said horn member and said outer wall member comprises graphite-containing laminate material.

12. A waveguide-fed horn antenna according to claim 11, wherein said interior faces of said flared portions of said horn member are formed of a layer of conductive material disposed on the graphite-containing laminate material thereof.

13. A waveguide-fed horn antenna according to claim 1, wherein each of said horn member and said outer wall member has a coefficient of thermal expansion at least several orders of magnitude less than that of said waveguide.

14. 10. A waveguide-fed horn antenna according to claim 1, wherein each of said horn member and said outer wall member comprises graphite-containing laminate material.

15. A waveguide-fed horn antenna according to claim 14, wherein said interior faces of said flared portions of said horn member are formed of a layer of conductive material disposed on the graphite-containing laminate material thereof.

16. A waveguide-fed horn antenna according to claim 15, wherein said interior faces of said flared portions of said horn member are corrugated.

17. A waveguide-fed horn antenna according to claim 15, wherein said interior faces of said flared portions of said horn member are flat-surfaced.

18. For use with a waveguide-fed horn antenna wherein a waveguide feed element is electrically contiguous with a conductive surface of flared portions of a horn member, a method of constraining the deformation of said antenna in response to changes in thermal environment comprising the steps of:

securing said waveguide fed element and said flared portions of said horn member to sections of deformation constraining, thermal load-absorbing dielectric material; and securing said horn member and said sections of deformation constraining thermal load-absorbing dielectric material to a thermally insulative outer wall member which extends from said flared portions of said horn member so as to surround that portion of said horn member and said waveguide feed element other than the electromagnetic radiation coupling portion thereof, and so as to effectively shift the center of mass of said waveguide-fed horn to location within a section of deformation-constraining, thermal load-absorbing dielectric material to which said waveguide feed element is secured.

19. A method according to claim 18, further comprising the step of forming said horn member of thermally insulative material having a recessed pocket portion receiving said waveguide feed element and a pair of flared portions extending from said pocket portion, interior faces of said flared portions having formed thereon a layer of conductive material that is electrically contiguous with said waveguide feed element.

20. A method according to claim 19, wherein said sections of deformation constraining thermal load-absorbing dielectric material is formed of a graphite-containing cellular structure.

21. A method according to claim 20, wherein the thermally insulative material of which said outer wall member and said horn member are formed comprises a graphite-containing laminate material.

22. A method according to claim 21, further comprising the step of filling those regions of the interior spaced defined between said horn member and said outer wall member, other than whereat said sections of deformation-constraining, thermal load-absorbing dielectric material are disposed with a syntactic filler material.

23. A method according to claim 19, wherein said interior faces of said flared portions of said horn member are corrugated.

24. A method according to claim 19, wherein said interior faces of said flared portions of said horn member are flat-surfaced.

* * * * *